US009815604B2

(12) United States Patent
Ekkert

(10) Patent No.: US 9,815,604 B2
(45) Date of Patent: Nov. 14, 2017

(54) TAMPER-EVIDENT BAND ASSEMBLY

(71) Applicant: PHOENIX CLOSURES, INC., Naperville, IL (US)

(72) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 64 days.

(21) Appl. No.: 15/010,639

(22) Filed: Jan. 29, 2016

(65) Prior Publication Data

US 2017/0217653 A1 Aug. 3, 2017

(51) Int. Cl.
*B65D 55/08* (2006.01)
*B65D 43/02* (2006.01)

(52) U.S. Cl.
CPC ..... *B65D 55/0827* (2013.01); *B65D 43/0237* (2013.01)

(58) Field of Classification Search
CPC ..... B65D 41/3457; B65D 2101/0046; B65D 55/0287; B65D 41/3447; B65D 2543/00092; B65D 2543/00296
See application file for complete search history.

(56) References Cited

U.S. PATENT DOCUMENTS 4,527,704 A 7/1985 Swartzbaugh
4,576,298 A * 3/1986 Boik ..... B65D 41/3457 215/225
4,610,367 A * 9/1986 Massott ..... B65D 41/3457 215/252
4,679,696 A 7/1987 Bonnenfant et al.
4,700,859 A 10/1987 Gregory
4,746,026 A * 5/1988 Leonhardt ..... B65D 41/3457 215/252
5,076,453 A 12/1991 Odet
5,249,695 A 10/1993 Luch et al.
7,578,404 B2 * 8/2009 Ekkert ..... B65D 41/3457 215/252
7,891,510 B2 2/2011 Loughrin et al.
8,052,004 B2 11/2011 Cheng et al.
8,292,104 B2 10/2012 Cheng
8,353,413 B2 1/2013 Ekkert
2002/0166836 A1 11/2002 Moretti et al.
2008/0149586 A1 6/2008 Loughrin et al.
2010/0233394 A1 9/2010 Morini et al.

* cited by examiner

*Primary Examiner* — Shawn M Braden
(74) *Attorney, Agent, or Firm* — Husch Blackwell LLP

(57) ABSTRACT

A two-piece tamper-evident band assembly for use with a container and closure combination, where the container has a peripheral collar and the closure has a skirt, is shown. The tamper-evident band assembly includes a breakaway band frangibly connected to a staying ring. The staying ring has decreased flexibility where it connects to the container and closure combination, which prevents the assembly from deforming in a manner that will cause the assembly to fail to indicate that the container has been opened. The tamper-evident band assembly also indicates whether the container has been compromised without requiring modification of the container or the closure and can be applied to existing container and closure combinations that lack a tamper-evident system, allowing the assembly to be used with a variety of container and closure combinations.

15 Claims, 14 Drawing Sheets

TAMPER-EVIDENT BAND ASSEMBLY

FIELD OF THE INVENTION

The present invention relates to a tamper-evident band assembly used with a container and closure combination that indicates when the container has been opened.

BACKGROUND OF THE INVENTION

Many container and closure combinations are used to package, store, and ship a variety of commercial products, including foods and medicines. In the packaging of such products, it has become common practice to include some signal to indicate whether the closure has been opened or unsealed, providing a warning that the contents may have been tampered with or damaged by exposure to the environment outside the container.

Tamper-evident assemblies help manufacturers, merchants, and consumers to easily identify compromised containers. They enable consumers to avoid products that may have been exposed to the environment, tampered with, or otherwise compromised. Those skilled in the art will understand that such container and closure combinations are made with containers of various sizes with openings of various sizes and shapes and with closures of various sizes and shapes, depending on the type of product packaged within.

A common example of a container and closure combination includes a container having a circular opening and a peripheral collar, along with a closure having a circular top and skirt. A typical container and closure combination may have a tamper-evident assembly incorporated as a part of the container, the closure, or both. There is a need for a tamper-evident assembly that can be manufactured independently of such containers and closures, and without requiring modifications to either the container or the closure. There is also a need for tamper-evident band assemblies for use with container and closure combinations that have already been designed or manufactured without a system to indicate tampering.

There is also a need for tamper-evident assemblies that do not fail when exposed to the stresses placed on them when the containers are opened. If the applied stresses cause a tamper-evident assembly to stretch or otherwise deform, the tamper-evident assembly may slip over the peripheral collar of the container when the closure is removed. In this case, the closure may be re-closed and subsequent handlers of the container will remain ignorant that the container has compromised. For the consumer, even a single failure of this type may have dangerous, even deadly, consequences.

There is also a need for indicators of tampering that are readily apparent to casual view. Some tamper-evident indicators are visible only when the closure is removed. While a consumer may be warned of compromised products, the warning may be received too late for the consumer to select an uncompromised container. Some tamper-evident band assemblies rely on relatively subtle changes in configuration to signal tampering, changes may be easy to overlook. There is a need for a tamper-evident assembly that provides clear visual signals to indicate tampering.

Tamper-evident band assemblies are ineffective if they have even a low failure rate, either because the assembly fails to work or because individuals fail to recognize the indication that the container has been opened. Therefore, there is a need to develop a tamper-evident band assembly that addresses the shortcomings of present constructions that indicate tampering in container and closure combinations.

BRIEF SUMMARY OF THE INVENTION

The present invention relates to two-piece tamper-evident band assemblies used in container and closure combinations where the container has a peripheral collar and the closure has a skirt. An embodiment includes a container and closure combination coupled to a tamper-evident band assembly that includes a breakaway band that is frangibly connected by a plurality of frangible connectors to an outer periphery of a staying ring positioned laterally inward. The staying ring is defined by an inner dimension that is less than a corresponding outer dimension of the peripheral collar of the associated container, and the breakaway band is defined by an inner dimension that is greater than the corresponding outer dimension of the staying ring.

The tamper-evident band assembly may be molded as a unitary piece. The breakaway band may have at least one downward-angled shoulder that engages the skirt of the closure so that the closure and the tamper-evident band assembly cooperate with one another. The staying ring includes at least one upward-angled ledge that extends upward and inward from its lower periphery, the upward-angled ledge engaging the peripheral collar of the container so that the container and the tamper-evident band assembly cooperate with one another. In some embodiments, the downward-angled shoulder is continuous, and in other embodiments, the downward-angled shoulder includes breaks formed therein so that there is a plurality of discrete downward-angled tabs. In some embodiments, the upward-angled ledge is continuous, and other embodiments, the upward-angled ledge includes breaks formed therein so that there is a plurality of discrete upward-angled tabs.

The skirt of the closure is positioned between the downward-angled shoulder of the breakaway band and the top periphery of the staying ring, so that the closure cooperates with the tamper-evident band assembly.

After the tamper-evident band assembly is placed onto the container and closure combination, the removal of the closure from the container applies upward force on the breakaway band of the tamper-evident band assembly. Upward movement of the staying ring is prevented because the upward-angled ledge of the staying ring is stopped by the peripheral collar of the container. As the closure continues to move upward, the skirt applies upward force to the downward-angled shoulder of the breakaway band. The upward movement of the breakaway band causes the frangible connectors to tear away from the stationary staying ring. When sufficient upward force is applied, the breakaway band disconnects from the tamper-evident band assembly and the staying ring remains positioned on the container. This may provide one or more visual signals that the container has been opened, including a change in the composition or appearance of the tamper-evident band assembly, a change in the appearance of the closure by the increased exposure of its skirt, or a loss of some piece of the assembly.

In some embodiments, the container and closure are twisted off and in some embodiments, the container and closure are snap-on assemblies that are pulled off, instead of being twisted off. In some embodiments, the closure, container, and tamper-evident band assemblies can be defined by various shapes, such as, square, oval and the like.

Because the tamper-evident band assembly of the subject invention may be comprised of two separate pieces, larger diameter assemblies may be molded without the use of slides or other additional pieces in the mold. As a result, a larger number of assemblies may be manufactured during one molding operation. Manufacturing efficiency, therefore, is enhanced and costs are reduced.

Because the two-piece tamper-evident band assemblies are made separately from the containers, they may be made at different times and places and the assemblies may be added to containers or closures that have already been designed or manufactured, without requiring alterations to the containers or closures. The design of the tamper-evident band assembly may be modified to accommodate container and closure combinations of different sizes and configurations.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
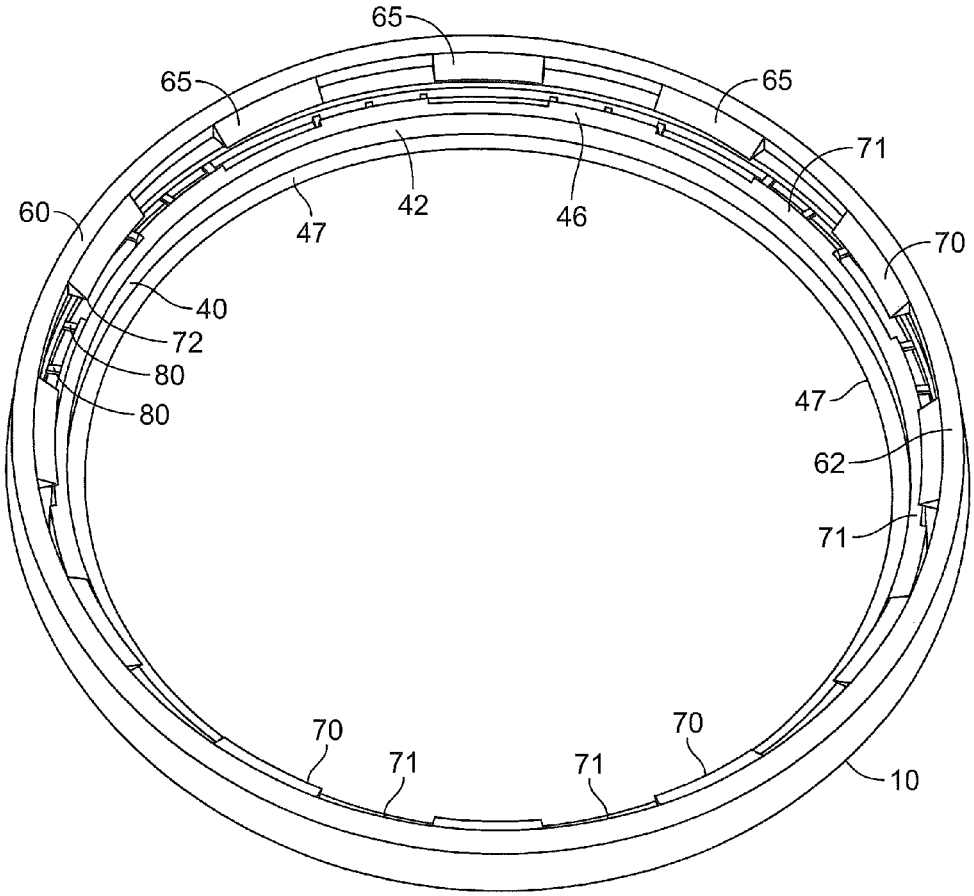
FIG. 1 shows a top perspective of an embodiment of the tamper-evident band assembly.
Figure 2:
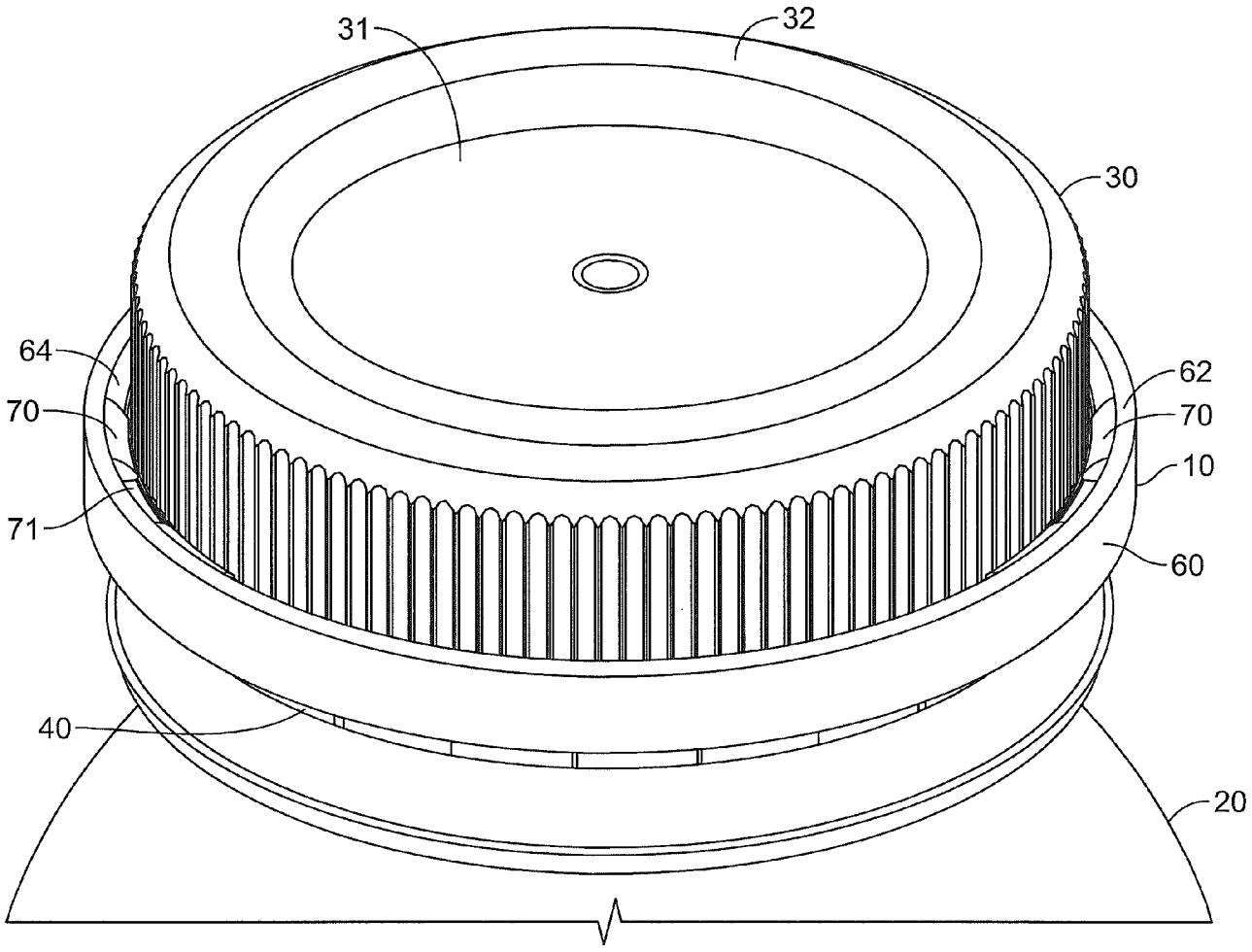
FIG. 2 shows an assembled perspective view of an embodiment of the tamper-evident band assembly used on a container and closure combination.
Figure 3:
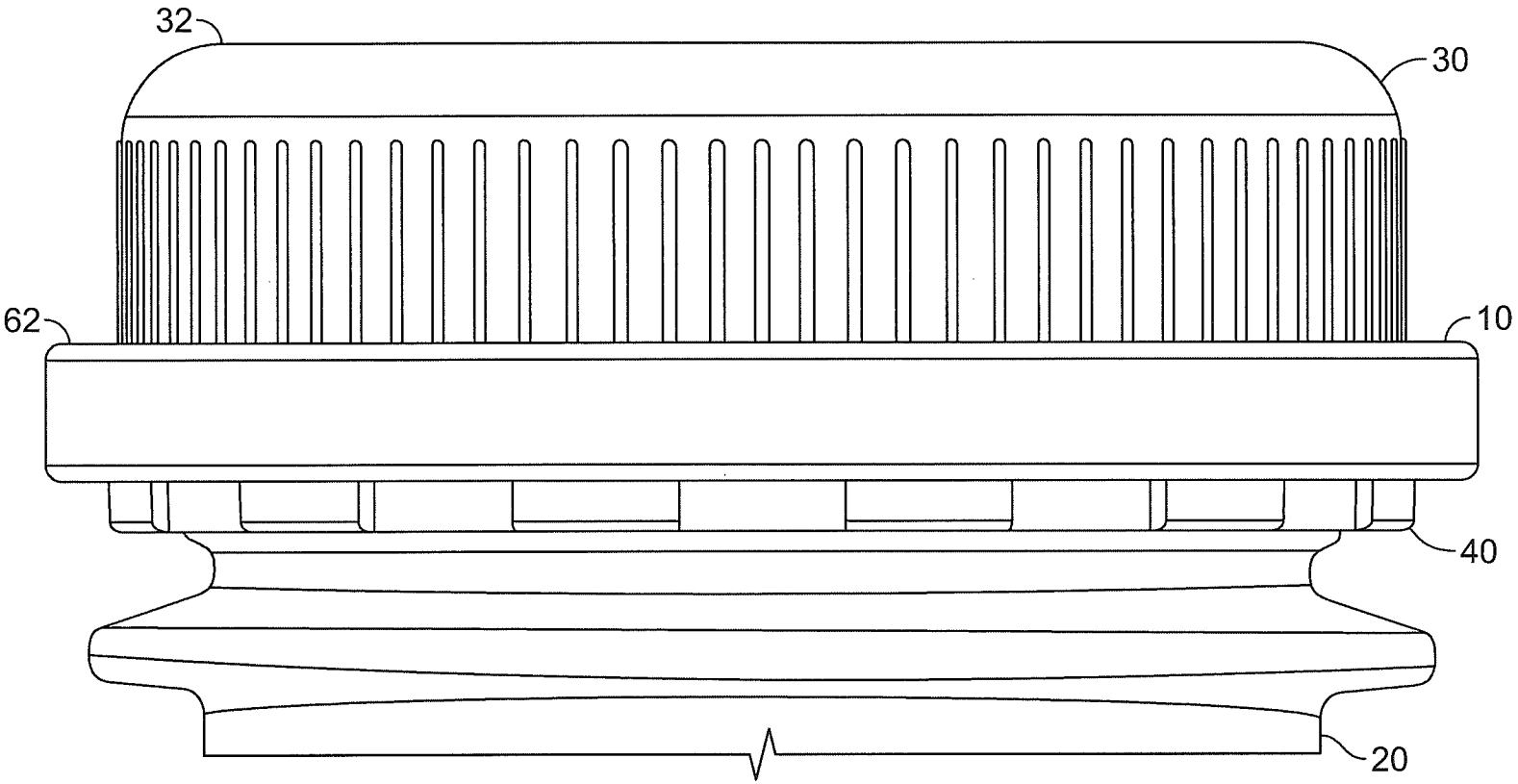
FIG. 3 shows an assembled and enlarged side view of an embodiment of the tamper-evident band assembly used on a container and closure combination.

While this invention is susceptible of embodiments in many different forms, there are shown in the drawings and will be described in detail herein specific embodiments with the understanding that the present disclosure is to be considered as an exemplification of the principles of the invention. It is not intended to limit the invention to the specific illustrated embodiments.

The features of the invention disclosed herein in the description, drawings, and claims can be significant, both individually and in any desired combinations, for the operation of the invention in its various embodiments. Features from one embodiment can be used in other embodiments of the invention.

It should be further understood that the title of this section of this specification, namely, "Detailed Description Of The Invention," relates to a requirement of the United States Patent & Trademark Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

As used herein, the term "ring" shall mean a strip that has a shape. For example, when the closure and container have circular shapes, the staying ring, likewise, has a circular shape; likewise, when the closure and container are square, so too is the staying ring.

As used herein, the term "band" shall mean a strip that has a shape. For example, when the closure and container have circular shapes, the breakaway band, likewise, has a circular shape; likewise, when the closure and container are square, so too is the breakaway band.

The present invention relates to two-piece tamper-evident band assemblies 10 used in container 20 and closure 30 combinations where the container 20 has a peripheral collar 24 and the closure 30 has a skirt 36.

Figure 9:
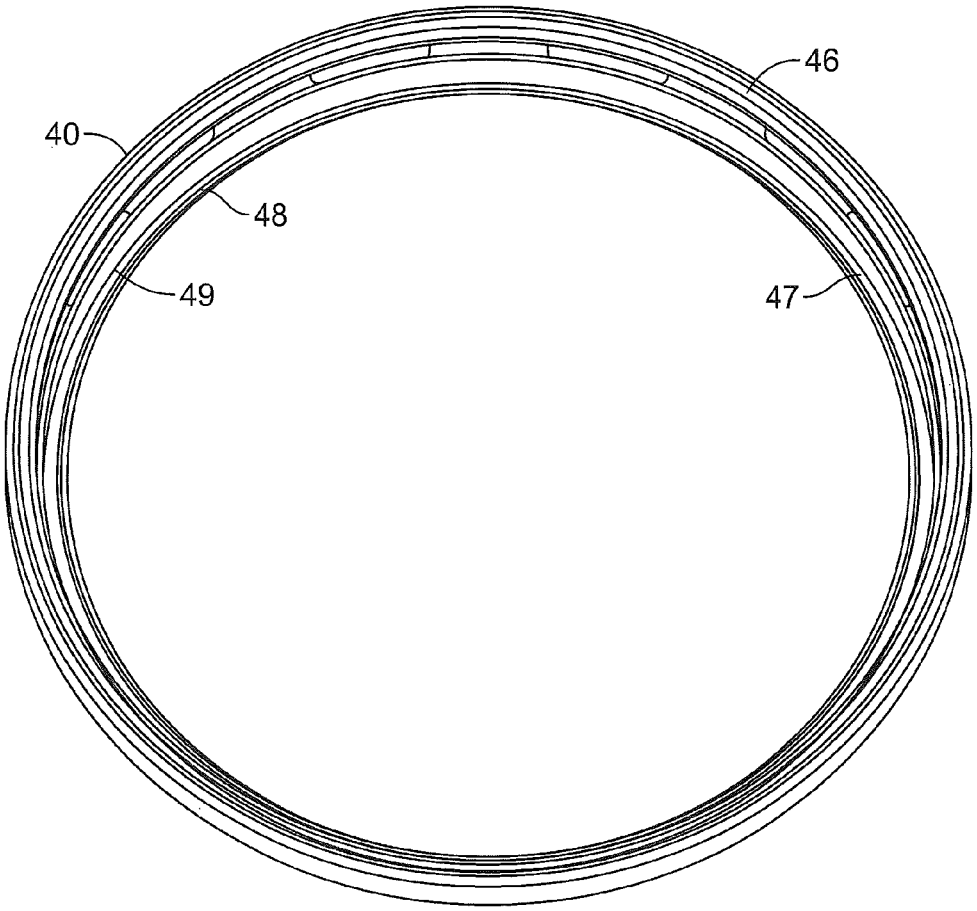
FIG. 9 shows a top perspective of a staying ring.
Figure 10:
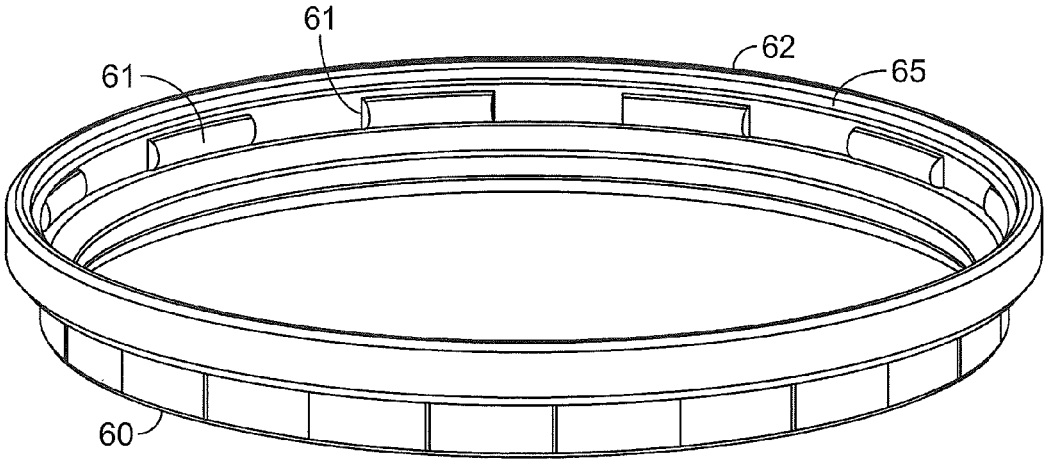
FIG. 10 shows a top perspective of a breakaway band.
Figure 11:
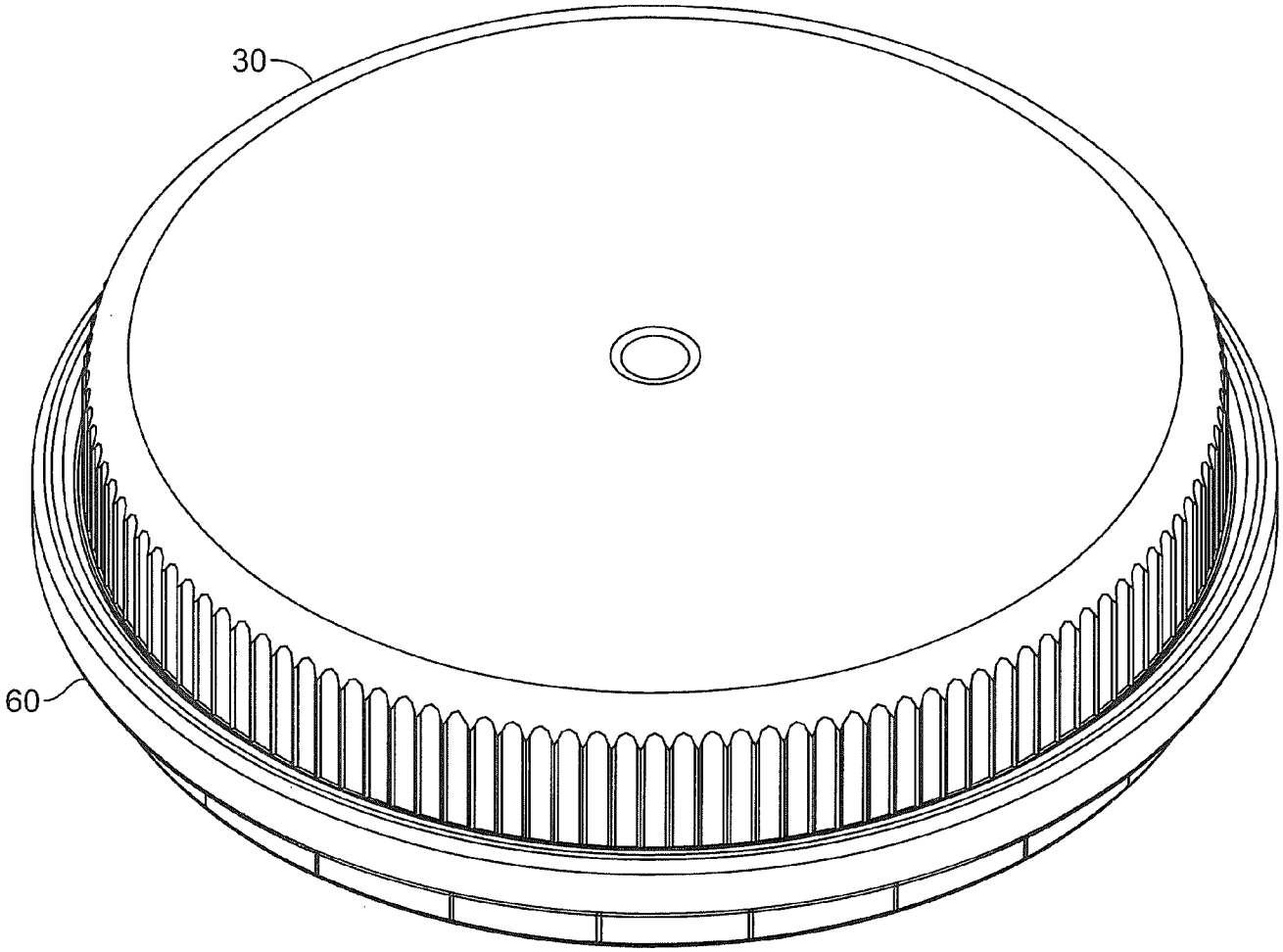
FIG. 11 shows a tamper-evident assembly associated with a closure.
Figure 12:
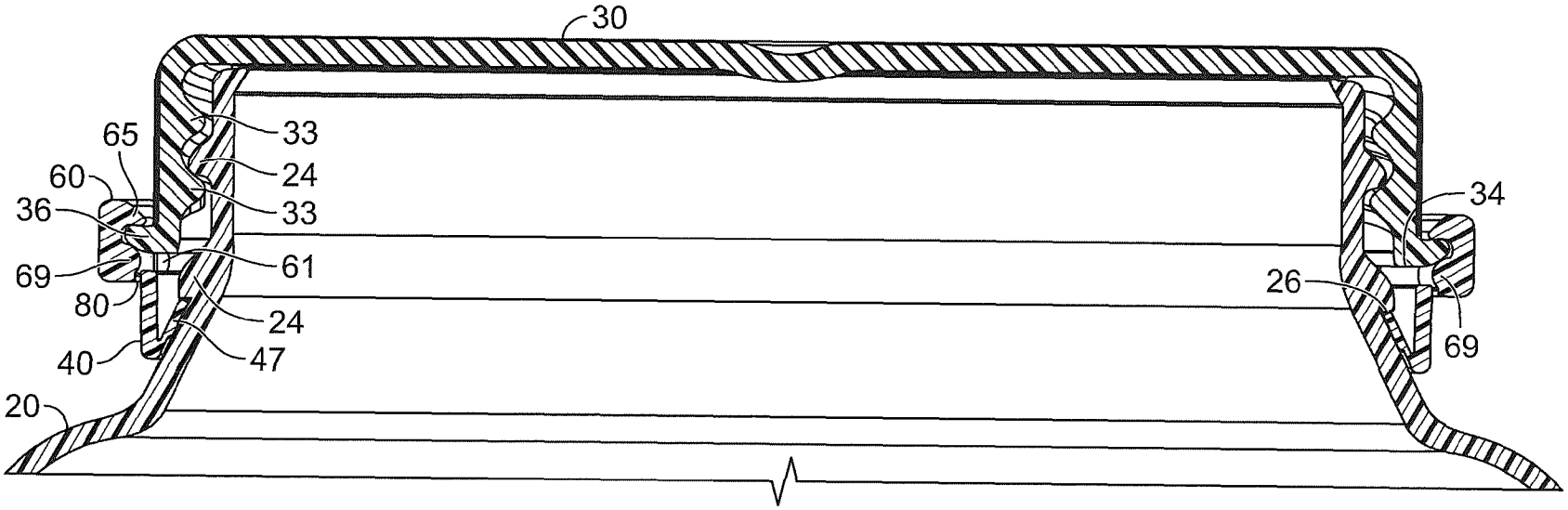
FIGS. 12 and 13 show cut-away and enlarged side views of embodiments of the present invention.
Figure 13:
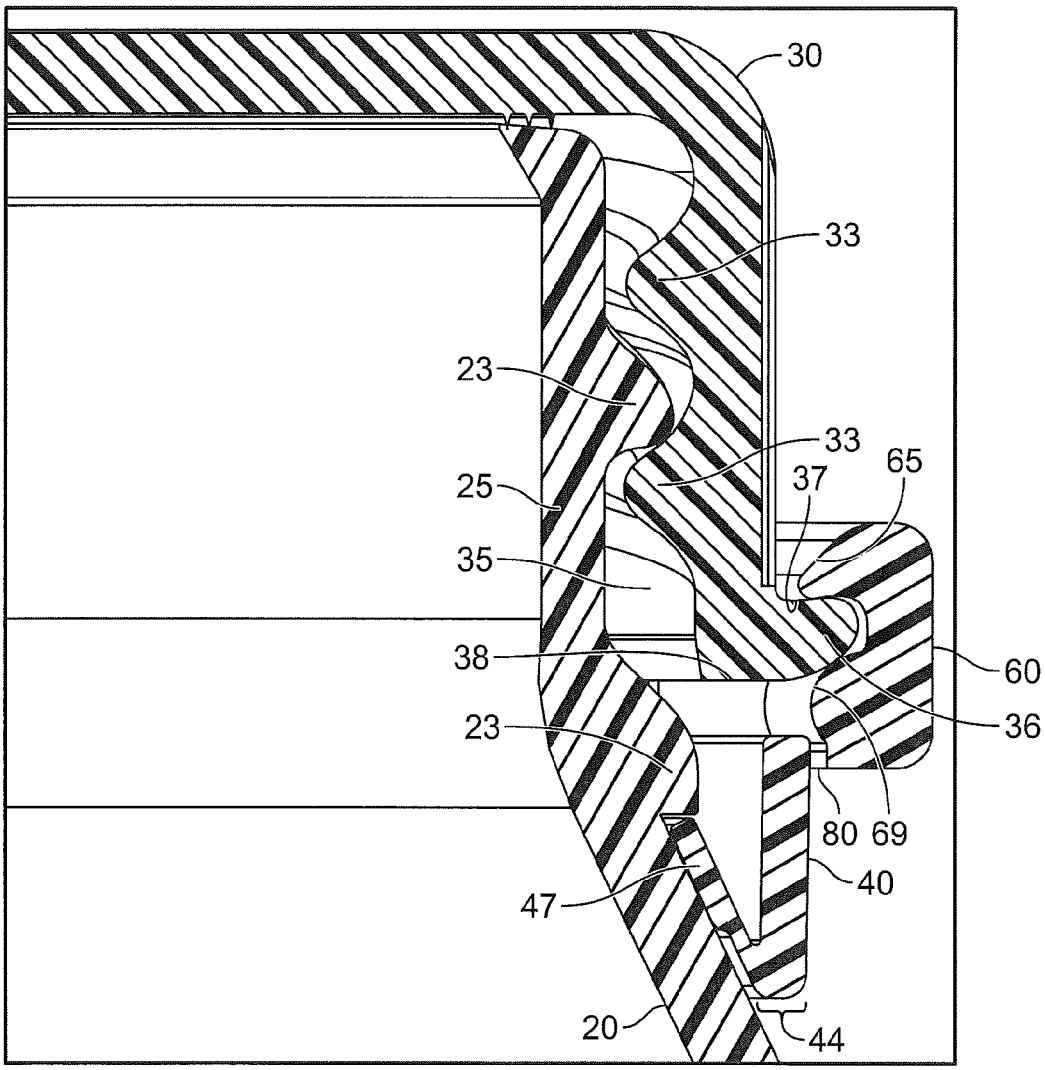
Figure 14:
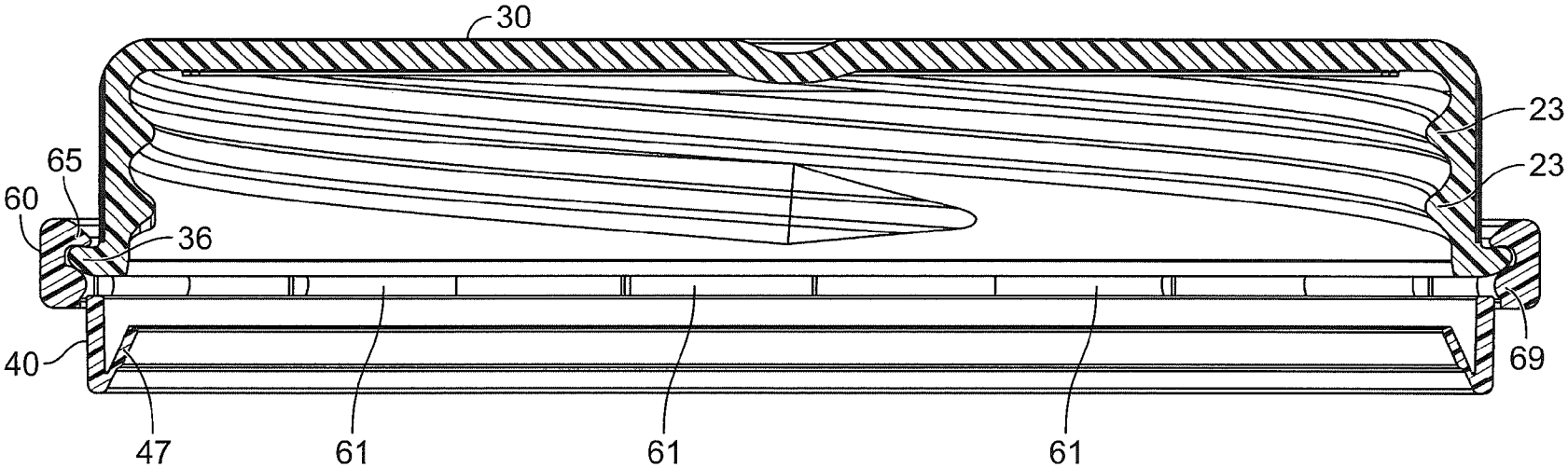
FIGS. 14 and 15 show cut-away and enlarged partial side views of embodiments of the present invention associated with a closure.
Figure 15:
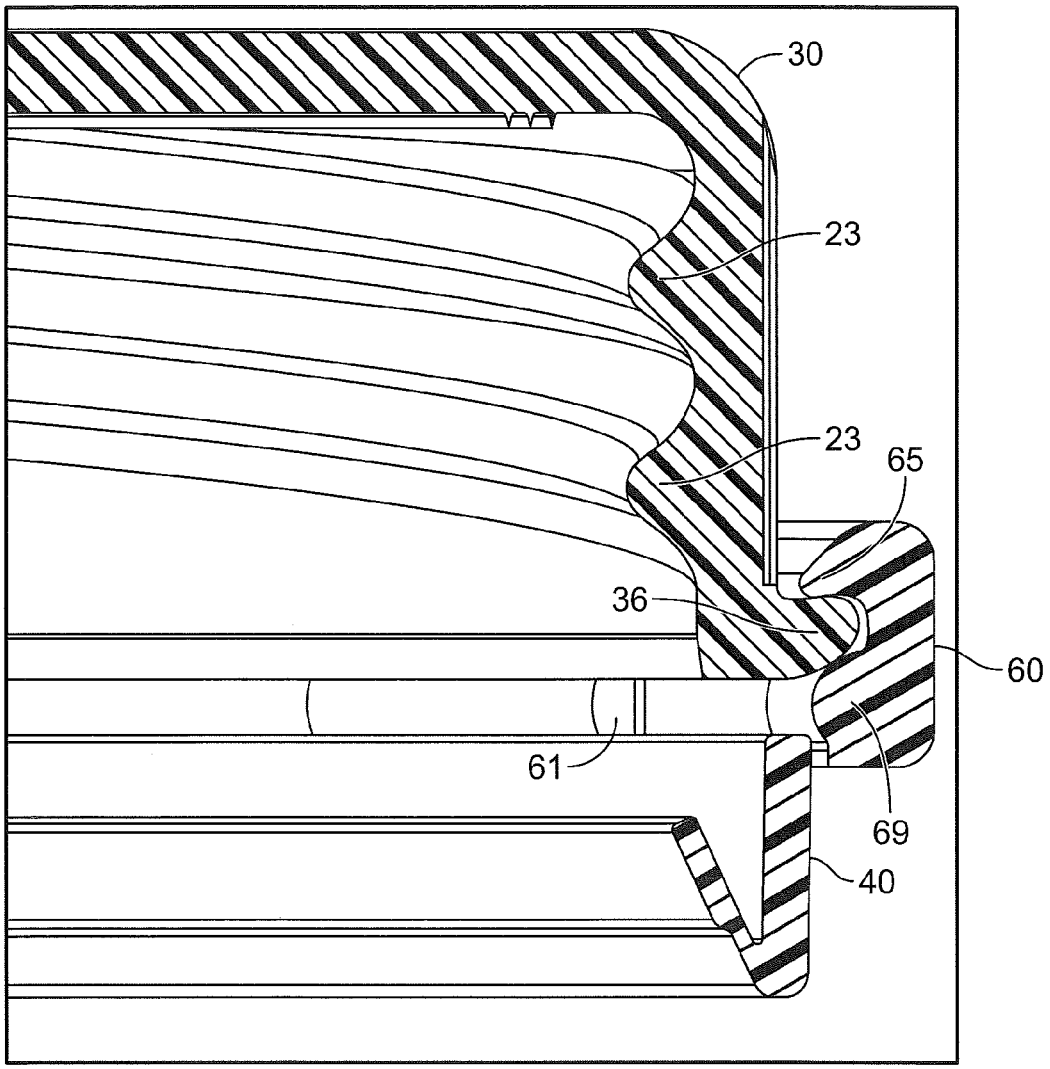

FIGS. 1-8 and 11-15 show preferred embodiments of the two-piece tamper-evident band assembly 10 associated with a closure 30 with a skirt 36 at its bottom periphery 34, the two pieces cooperating with each other when applied to an associated container 20 having an opening 22, a neck 25 which may have threads 23, and a peripheral collar 24. FIG. 9 shows an embodiment of a staying ring 40 and FIG. 10 shows an embodiment of a breakaway band 60, the two components of a tamper-evident band assembly.

Referring to FIGS. 1-15, the tamper-evident band assembly 10 includes a staying ring 40, which attaches laterally inward of a breakaway band 60. The staying ring 40 is frangibly connected to the breakaway band 60 by a plurality of frangible connectors 80 that extend laterally and outwardly from the exterior face 41 of the staying ring 40 to an interior periphery 64 of the breakaway band 60. In some embodiments, the plurality of frangible connectors 80 may extend laterally outward in a horizontal plane (FIGS. 4-7). In some embodiments, the plurality of frangible connectors 80 may be positioned closer to the top periphery 46 than the bottom periphery 44 of the staying ring 40.

At an upper periphery 62 of the breakaway band 60, a shoulder 65 extends laterally inward and angles downward from the upper periphery 62. The breakaway band 60 cooperates with the staying ring 40 so that the downward-angled shoulder 65 is above the staying ring 40.

Figure 7:
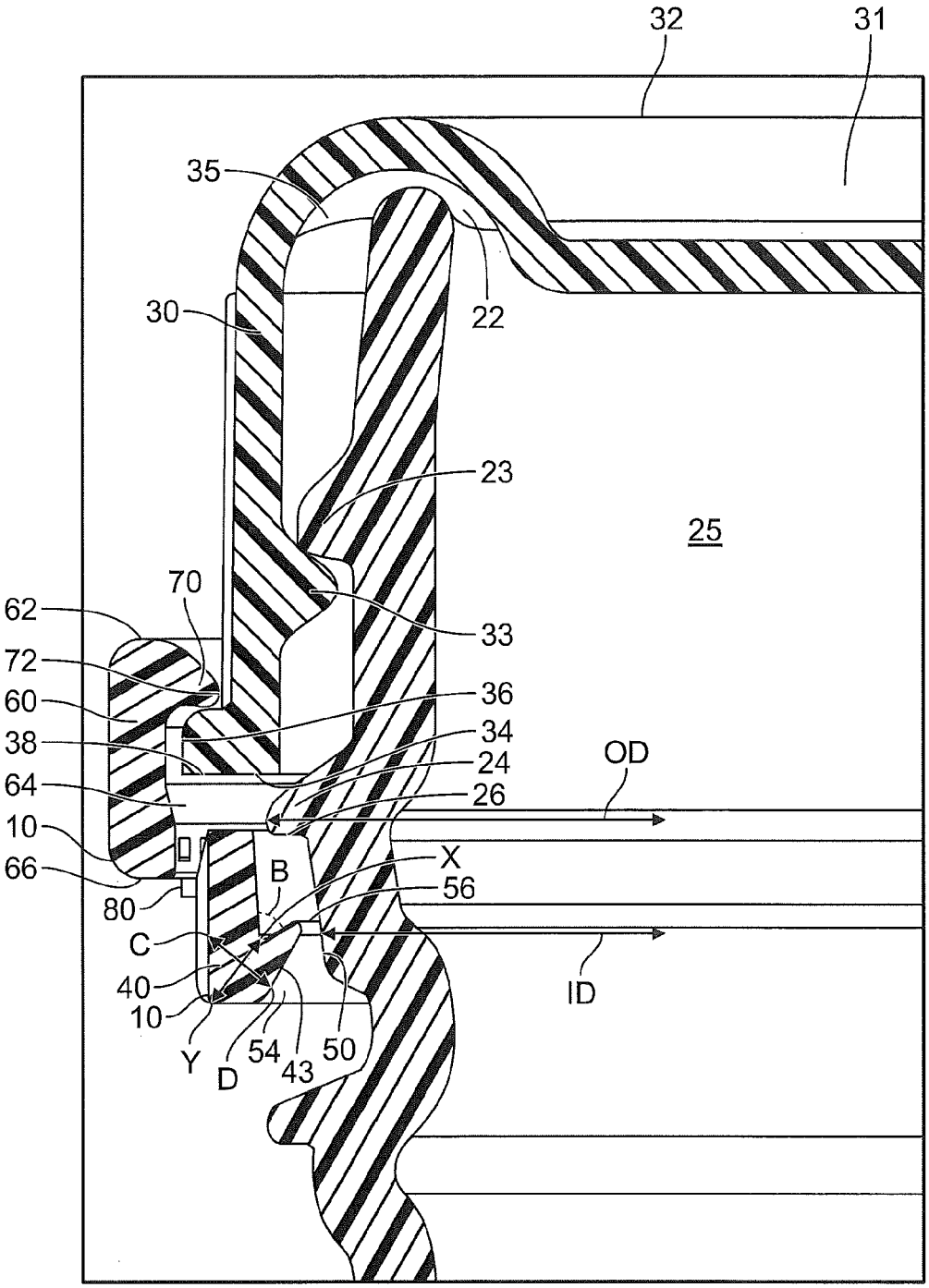
FIG. 7 shows a cut-away and enlarged side view of an embodiment of the present invention incorporating a plurality of upward-angled tabs in cooperation with a container and closure combination, where the frangible connectors are disconnected.
Figure 8:
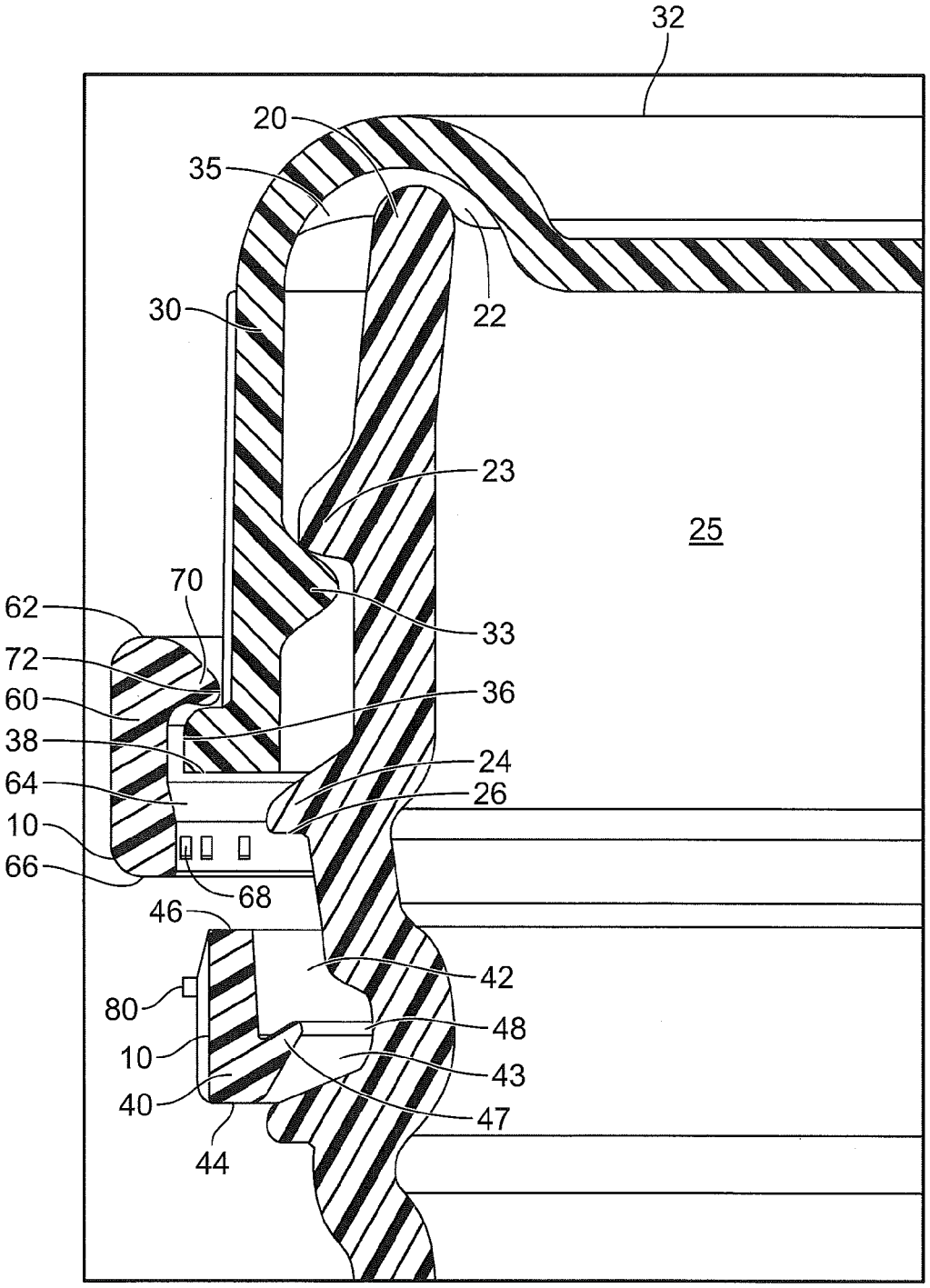
FIG. 8 shows a cut-away and enlarged side view of an embodiment of the present invention incorporating a continuous upward-angled ledge in cooperation with a container and closure combination, where the frangible connectors are disconnected.

In some embodiments, the downward-angled shoulder 65 may be uninterrupted and continuous and extend laterally inward and downward (i.e., FIGS. 7, 9). In some embodiments, the downward-angled shoulder 65 may include a plurality of tabs 70 that extend laterally inward and downward, with breaks 71 between the tabs 70 (i.e., FIG. 6). When assembled to the staying ring 40, the plurality of frangible connectors 80 may attach to the interior periphery 64 of the breakaway band 60 below the downward-angled shoulder 65. The exact shape and position of the frangible connectors 80 may vary, but will attach together and function as a frangible connection between the staying ring 40 and the breakaway band 60.

Because the tamper-evident band assembly 10 and the container 20 may be comprised of two separate pieces, they may be easier to mold and allow for more tamper-evident band assemblies to be molded during a single molding operation. In some embodiments, the tamper-evident band assembly 10 and the closure 30 may be made of the same material. In other embodiments, tamper-evident band assembly 10 and the closure 30 may be made of different materials. In some embodiments, the tamper-evident band assembly 10 may include at least one material selected from the group consisting of polyolefin. In some embodiments, the associated closure 30 may include at least one material from the group consisting of polycarbonate, acrylonitrile butadiene styrene, nylon, butadiene, proprionate, and acrylic polymers.

At the bottom periphery 44 of the staying ring 40, an upward-angled ledge 47 may extend laterally inward and upward. As shown in the embodiments of FIGS. 4, 6, and 14-15, the upward-angled ledge 47 may be a continuous ledge; or, as shown in the embodiment of FIGS. 5 and 7, may desirably include several breaks formed therein so that the upward-angled ledge 47 includes a plurality of upward-angled tabs 50. The upward-angled ledge 47 of the staying ring 40 is preferably positioned below the downward-angled shoulder 65 of the breakaway band 60 and may facilitate the molding of the breakaway band 60.

The staying ring 40 has at least one upward-angled ledge 47 of a thickness sufficient to avoid flexure, extending upward and inward from a bottom periphery 44. In some embodiments, the staying ring 40 may include a continuous upward-angled ledge 47 including an upper edge 48 that is positioned below a bottom surface 38 of the skirt 36 of the closure 30, and the staying ring 40 is positioned laterally inward of the breakaway band 60.

In some embodiments, the staying ring 40 may have plurality of upward-angled tabs 50, each upward-angled tab 50 having a thickness sufficient to avoid flexure, extending upward and inward from a bottom periphery 44, each upward-angled tab 50 having a tip positioned below a bottom surface 38 of the skirt 36 of the closure 30, and the staying ring 40 positioned laterally inward of the breakaway band 60.

In embodiments with a staying ring 40 with a continuous upward-angled ledge 47 (FIGS. 4 and 6), the upward-angled ledge 47 may include an upper edge 48 and an inner periphery 49. The inner periphery 49 and an interior face 42 of the staying ring 40 form an angle at the upward-angled ledge 47 designated as a (FIG. 6) from about and including 1-90 degrees. In a preferred embodiment, an $\alpha$ angle may be from about and including 20-40 degrees, as defined where the interior face 42 of the staying ring 40. The acute upward angle may contribute to the inflexibility of the upward-angled ledge 47 by decreasing the ability of the upward-angled ledge 47 to flex either upward or downward, thus reducing the risk that the upward-angled ledge 47 will deform and slip over the peripheral collar 24 of the container 20 when the closure 30 is removed. In turn, this may decrease the failure rate of the tamper-evident band assembly 10.

In embodiments with a staying ring 40 with a plurality of upward-angled tabs 50 (FIGS. 5 and 7), each of the upward-angled tabs 50 may include an inner face 52 and an outer face 54, and may be angled inward and upward, with breaks between the upward-angled tabs 50. The interior face 42 of the staying ring 40 and the inner faces 52 of each upward-angled tab 50 may form angles designated as $\beta$ (FIG. 7) from about and including 1-90 degrees. In a preferred embodiment, $\beta$ angles are from about and including 20-40 degrees, as defined where the inner face 52 of each upward-angled tab 50. Each upward-angled tab 50 may have $\beta$ angles of the same size or $\beta$ angles of different sizes.

In some embodiments, the staying ring 40 may have a minimum or maximum thickness in one or more dimensions. For example, a thickness of the staying ring 40 may be specified by the length of a first transverse line 82 defined by the line XY (FIG. 6), which spans from the point where the upward-angled ledge 47 meets the interior face 42 of the staying ring 40 (point X) to the point where the bottom periphery 44 meets the exterior face 41 of the staying ring 40 (point Y). A preferred thickness of the first transverse line 82 may be 0.010-0.100 inches and a more preferred thickness of the first transverse line 82 may be 0.030-0.080 inches.

A thickness of the staying ring 40 may be specified by the length of a second transverse line 84 defined by the line CD (i.e., FIGS. 6-7), which is parallel to the bottom periphery 44 of the staying ring 40, where C is a point on the exterior face 41 of the staying ring 40, and D is a point on the outer periphery 43 of the upward-angled ledge 47. In some embodiments, the second transverse line 84 may bisect the first transverse line 82. A preferred thickness of the second transverse line 84 may be 0.010-0.100 inches.

Figure 4:
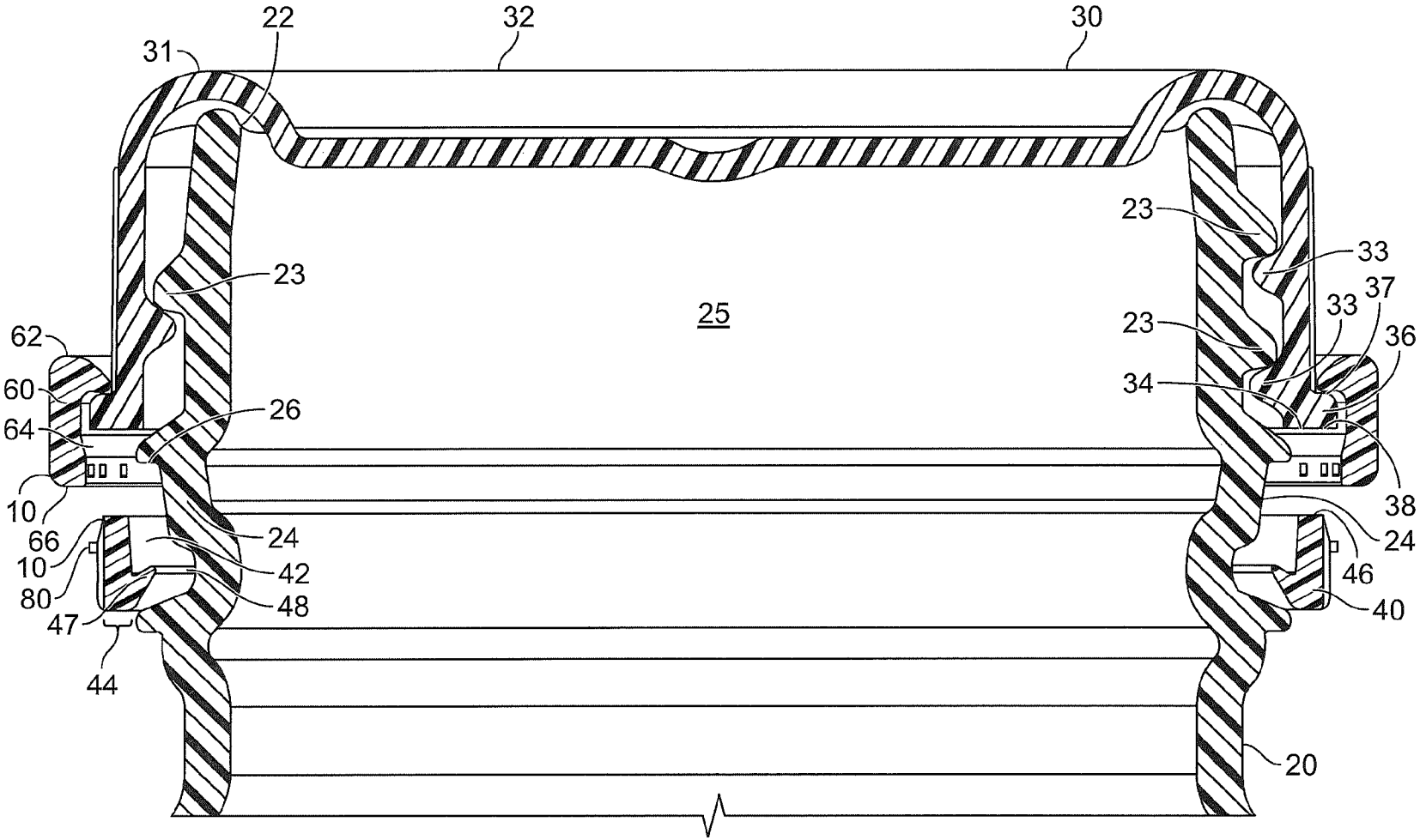
FIG. 4 shows a cut-away and enlarged side view of an embodiment of the present invention incorporating a continuous upward-angled ledge in cooperation with a container and closure combination, where the frangible connectors are disconnected.
Figure 5:
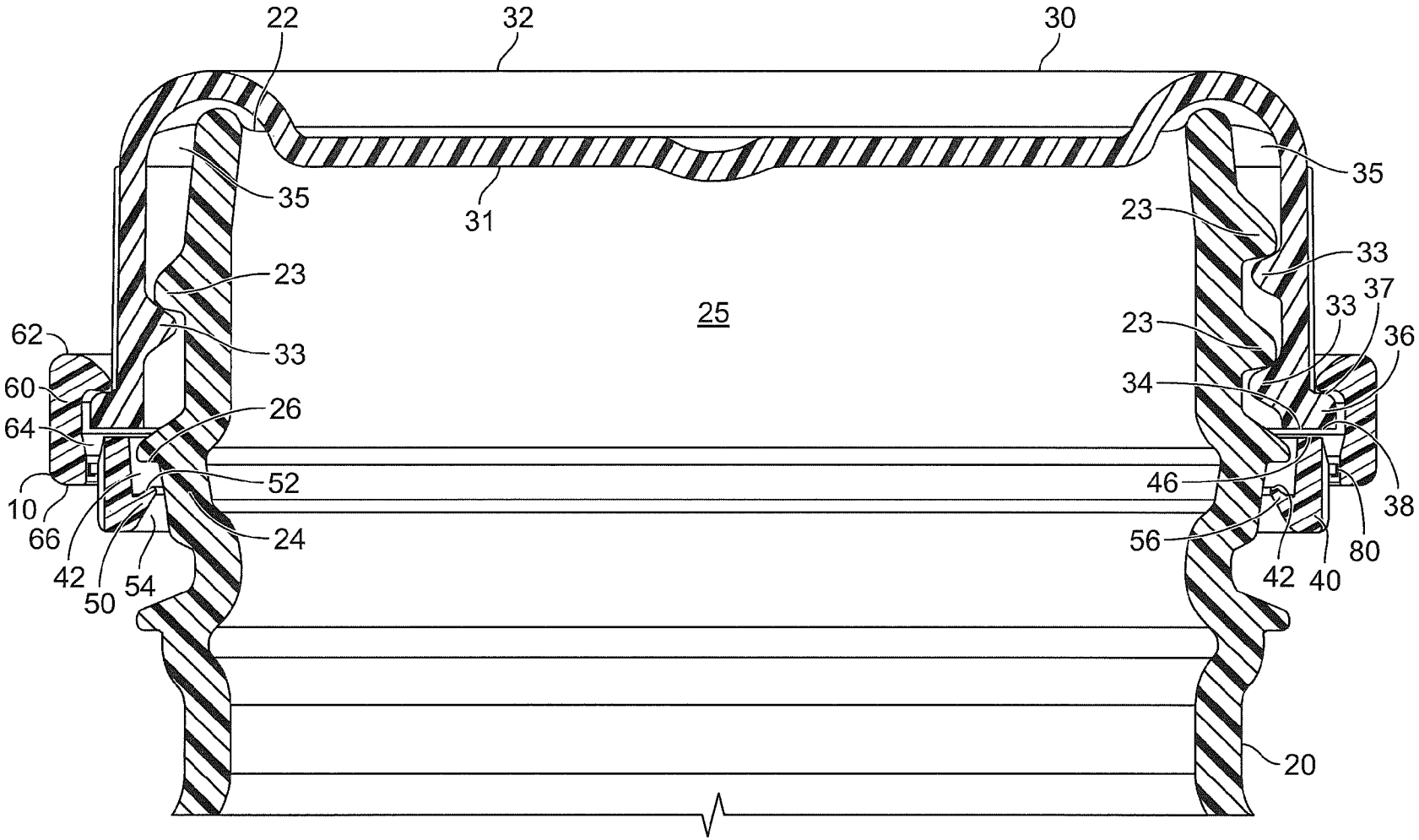
FIG. 5 shows a cut-away and enlarged side view of an embodiment of the present invention incorporating a plurality of upward-angled tabs in cooperation with a container and closure combination, where the frangible connectors are attached.
Figure 6:
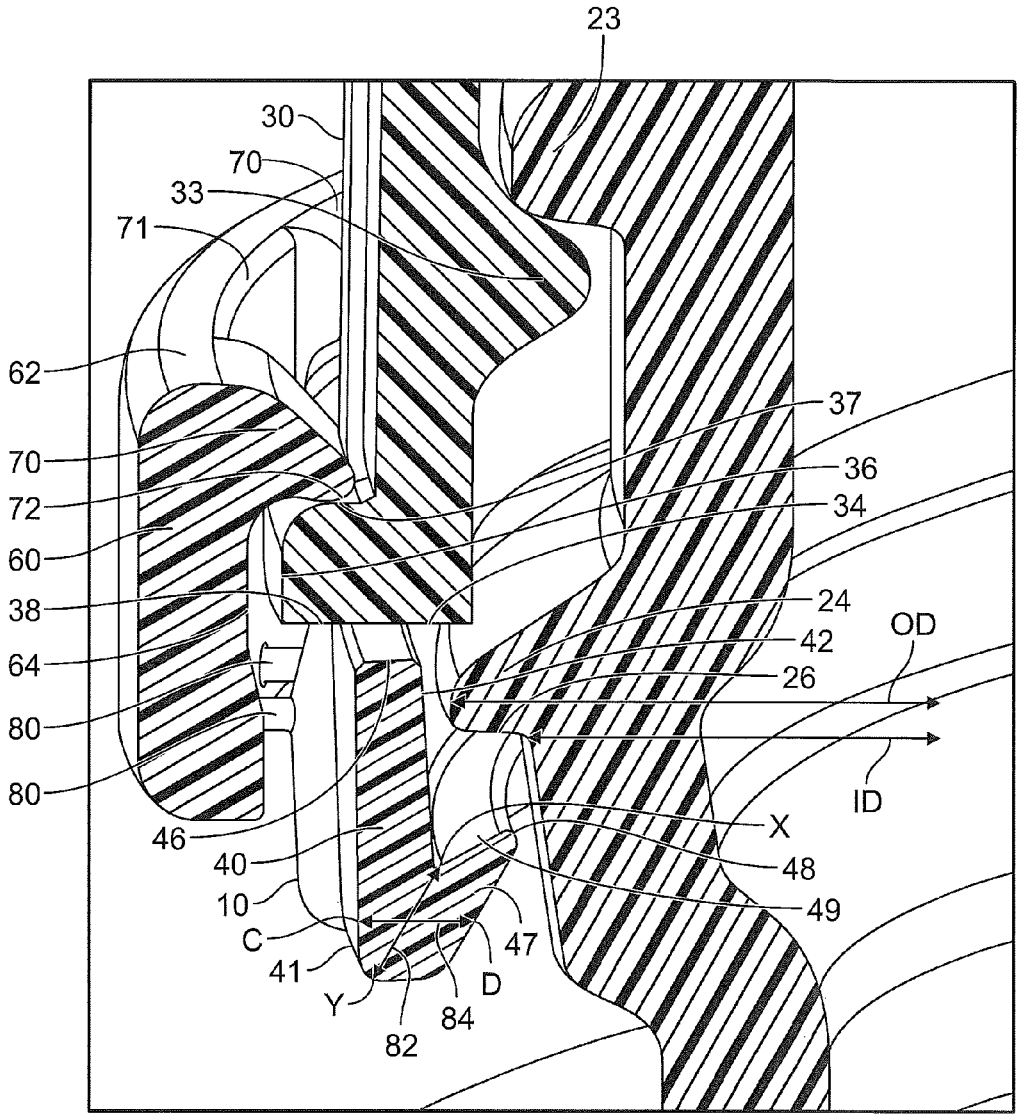
FIG. 6 shows a cut-away and enlarged side view of an embodiment of the present invention incorporating a continuous upward-angled ledge in cooperation with a container and closure combination, where the frangible connectors are attached.

A thickness of the staying ring 40 may also be may be specified by the length of the bottom periphery 44 of the staying ring 40 (i.e., FIG. 4).

The thickness of the staying ring 40, as defined by different transverse lines (82 or 84) or the length of the bottom periphery 44 of the staying ring 40, may also contribute to the inflexibility of the upward-angled ledge 47 sufficiently to withstand force and not flex, decreasing the ability of the upward-angled ledge 47 to flex either upward or downward and reducing the risk that the upward-angled ledge 47 will deform and slip over the peripheral collar 24 of the container 20 when the closure 30 is removed. In turn, this may decrease the failure rate of the tamper-evident band assembly 10.

In some embodiments, the breakaway band 60 may include at least one bead 61 on its interior periphery 64 (FIGS. 12-15). The at least one bead 61 may be in intimate contact with the bottom periphery 34 of the closure 30 when the tamper-evident band assembly 10 is installed onto the closure 30. The at least one bead 61 may contribute to the inflexibility of the upward-angled ledge 47 of the staying ring 40 sufficiently to withstand force and not flex, by decreasing the ability of the top periphery 46 of the staying ring 40 to flex either outward or inward and reducing the risk that the upward-angled ledge 47 will deform and slip over the peripheral collar 24 of the container 20 when the closure 30 is removed. In turn, this may decrease the failure rate of the tamper-evident band assembly 10.

In some embodiments, the breakaway band 60 may include at least one buttress 69 on its interior periphery 64 that is in intimate contact with the bottom surface 38 of the skirt 36 of the closure 30 when the tamper-evident band assembly 10 is installed onto the closure 30 (FIGS. 12-15). The buttress 69 may be in contact with the bottom surface 38 of the skirt 36 and provide a physical barrier to prevent the top periphery 46 of the staying ring 40 from flexing against the skirt 36 of the closure 30. The buttress 69 may contribute to the inflexibility of the upward-angled ledge 47 of the staying ring 40 sufficiently to withstand force and not flex, by providing a supplemental barrier that blocks the top periphery 46 of the staying ring 40 from flexing outward and reduces the risk that the upward-angled ledge 47 will deform and slip over the peripheral collar 24 of the container 20 when the closure 30 is removed. In turn, this may decrease the failure rate of the tamper-evident band assembly 10.

When the staying ring 40 and breakaway band 60 are assembled, they provide a way for individuals to visually detect whether the closure 30 of a container 20 has been opened or unsealed. In some embodiments, the tamper-evident band assembly 10 may be attached to the closure 30 before the closure 30 is attached to the container 20. In other embodiments, the closure 30 may be attached to the container 20 before the tamper-evident band assembly 10 is attached to the container 20.

FIGS. 2-8 show embodiments of a two-piece tamper-evident band assembly 10 associated with a container 20 and closure 30 combination. The closure 30 cooperates with the tamper-evident band assembly 10 and includes a top 31. The top 31 includes a skirt 36 that depends from a top periphery 32 of the top 31 and may have threads 33 formed on an inner surface 35 thereof. Note that in other embodiments incorporating a snap-on type closure (not shown) or other type of closure, the top need not have threads formed on its inner surface.

The tamper-evident band assembly 10 may be placed on the closure 30 so that the skirt 36 and the downward-angled shoulder 65 of the breakaway band 60 cooperate with each other. Thus, when the tamper-evident band assembly 10 and closure 30 are positioned onto the container 20, the upward-angled ledge 47 of the staying ring 40 may slip under and beneath the peripheral collar 24, as shown in FIGS. 4-7. The upward-angled ledge 47 may be defined by an inner dimension ID that is less than an outer dimension OD of the peripheral collar 24 of the container 20.

When the tamper-evident band assembly 10 and the container 20 and closure 30 combination are assembled together, the skirt 36 of the closure 30 may be positioned above the peripheral collar 24 of the container 20. The top periphery 46 of the staying ring 40 may be contiguous with a bottom surface 38 of the skirt 36 of the closure 30. In some embodiments, when assembled, the top periphery 46 of the staying ring 40 may contact the bottom surface 38 of the skirt 36 of the closure 30.

The upward-angled ledge 47 of the staying ring 40 may be positioned under the bottom surface 26 of the peripheral collar 24 of the container 20. In some embodiments, where the staying ring 40 has a plurality of upward-angled tabs 50, the tips 56 of the plurality of upward-angled tabs 50 of the staying ring 40 may be positioned under the bottom surface 26 of the peripheral collar 24 of the container 20. In some embodiments, where the staying ring 40 may have a continuous upward-angled ledge 47, the upper edge 48 of the upward-angled ledge 47 of the staying ring 40 may be positioned under the bottom surface 26 of the peripheral collar 24 of the container 20.

The downward-angled shoulder 65 of the breakaway band 60 may be positioned above an upper surface 37 of the skirt 36 of the closure 30. In some embodiments where the downward-angled shoulder 65 has a plurality of downward-angled tabs 70, the tips 72 of the plurality of downward-angled tabs 70 of the breakaway band 60 may be positioned above an upper surface 37 of the skirt 36 of the closure 30.

The tamper-evident band assembly 10 may be screwed or slid onto, or otherwise associated with, the container neck 25. For example, in some embodiments, threads 33 of the closure 30 and threads 23 on the container neck 25 cooperate with one another. The tamper-evident band assembly 10 is shown cooperating with a container 20 and closure 30 combination (FIGS. 4-8). The associated container 20 has an opening 22 and a peripheral collar 24. The closure 30 has a skirt 36 and when the closure 30 is fixed to the container 20, the skirt 36 is positioned above the peripheral collar 24 of the container 20. In some embodiments of the invention, the opening 22 may also contain, for example, a seal between the opening 22 and the closure 30 that protects the contents of the container 20.

While the container 20 remains unopened, the tamper-evident band assembly 10 remains intact. When the assembly 10 is positioned onto the container 20 and the closure 30, the upward-angled ledge 47 may be positioned below the peripheral collar 24 of the container 20 and may be defined by an inner dimension that is smaller than an outer dimension of the peripheral collar 24.

If the container 20 is opened or unsealed, the closure 30 moves away from the container 20 and moves the breakaway band 60 upward. When the closure 30 is removed from the container 20, the closure 30 moves upward, a bottom surface 26 of the peripheral collar 24 contacts the upper edge 48 of the upward-angled ledge 47, the peripheral collar 24 prevents the upward-angled ledge 47 of the staying ring 40 from moving upward, and an upper surface 37 of the skirt 36 moves the downward-angled shoulder 65 upward, moving the breakaway band 60 upward and tearing the plurality of frangible connectors 80 apart so that the breakaway band 60 breaks away from the staying ring 40 and the staying ring 40 remains positioned under the peripheral collar 24.

When the container 20 is unsealed, the upward-angled ledge 47 engages the bottom surface 38 of the skirt 36 of the closure 30. Because of its inflexibility, the upward-angled ledge 47 resists the applied force, refrains from disengagement, and remains engaged below the bottom surface 38 of the skirt 36. The skirt 36 blocks the upward movement of the staying ring 40 and when sufficient stress is applied, the plurality of frangible connectors 80 break. The breakaway band 60 detaches from the tamper-evident band assembly 10 and the staying ring 40 remains with the container 20 below the peripheral collar 24, providing visual evidence that the container 20 has been opened or unsealed. In some embodiments, the breakaway band 60 may fall or move away from the closure 30. In other embodiments, the breakaway band 60 may remain associated with the skirt 36 of the closure 30.

The container 20 and closure 30 are of standard configuration. An important aspect of some embodiments of the present invention is that the tamper-evident band assembly 10 may be used with a standard container 20 and closure 30 combination without requiring modifications or adaptations being made to the container 20 and the closure 30. Some embodiments of the present invention may be used in conjunction with container 20 and closure 30 combinations that have already been designed or manufactured.

Prior art tamper-evident systems were subject to a risk of failure under certain circumstances. For example, some tamper-evidence assemblies had insufficiently secure contact between a container and a tamper-evident assembly due to excessive flexibility in components of the tamper-evident assembly. If components of the tamper-evident assembly flexed downward when the closure was moved upward, then the tamper-evident assembly could fail to engage the peripheral collar of the container, causing the tamper-evident assembly to remain intact after the container was opened. Alternatively, if components of the tamper-evident assembly flex upward to too great a degree, then the components of the tamper-evident assembly could also fail to engage the peripheral collar of the container, causing the tamper-evident band assembly to remain intact after the container was opened. The opened containers could be re-closed and persons subsequently handling or receiving the sealed products would remain ignorant that the containers and their contents had been compromised. Even if these failure rates are low, a single failure could have severe, even deadly effects on consumers who rely on tamper-evident systems to provide clear warnings when the container has been opened or tampered with.

The present invention has several features that may render the upward-angled ledge 47 of the staying ring 40 inflexible to a degree sufficient to withstand the applied force and resist flexion, thus contributing to an improved failure rate. Some embodiments may include an upward-angled ledge 47 with acute upward angles that resist upward or downward flexion when stress is applied (i.e., when the closure 30 is opened). Some embodiments may include a minimum thickness in one or more dimensions of the staying ring 40, thus increasing its inflexibility and decreasing the likelihood of flexion either upward or downward in the upward-angled ledge 47 when the closure 30 is removed. Some embodiments may include a bead 61 on the breakaway band 60 the decreases the ability of the staying ring 40 (including its upward-angled ledge 47) to flex and deform.

The increased inflexibility of the staying ring 40 may improve the performance of the tamper-evident band assembly 10 by preventing the tamper-evident band assembly 10 from flexing enough to disengage from the bottom surface 38 of the skirt 36, thus decreasing the risk of failure upon the opening 22 of the container 20 and closure combination 30.

It should be readily apparent that the assembly can be used in a variety of orientations. As such, the reference in the application and claims to specific directions such as "top" and "bottom" are for purposes of identifying relative locations of the elements and are not intended to limit the claims to a specific orientation of the assembly.

Specific embodiments of a tamper-evident band assembly according to the present invention have been described for the purpose of illustrating the manner in which the invention can be made and used. It should be understood that the implementation of other variations and modifications of this invention and its different aspects will be apparent to one skilled in the art, and that this invention is not limited by the specific embodiments described. It is understood to encompass the present invention and any and all modifications, variations, or equivalents that fall within the spirit and scope of the basic underlying principles disclosed and claimed herein.

What is claimed is:

1. A tamper-evident band assembly for use with a container and closure combination, the container having a peripheral collar and the closure having a skirt, the assembly comprising:

a breakaway band having a shoulder extending inward and angling downward from an upper periphery; and a staying ring frangibly connected to the breakaway band by a plurality of frangible connectors, the staying ring having an upward-angled ledge of a thickness sufficient to avoid flexure, protruding upward and inward from a bottom periphery, the upward-angled ledge including an inner face angling inward and upward and having an upper end, an outer face angling inward and upward and having an upper end, and an upper edge defined where the upper ends of the inner face and outer face meet, the upper edge protruding inward and upward relative to the inner and outer faces, the upper edge for positioning against a bottom surface of the skirt of the closure, and the staying ring positioned laterally inward of the breakaway band, and the breakaway band cooperating with the staying ring so that the downward-angled shoulder is above the staying ring; and wherein when the assembly is positioned onto the container and the closure, the upward-angled ledge is positioned below the peripheral collar and is defined by an inner dimension that is smaller than an outer dimension of the peripheral collar, and wherein, when the closure is removed from the container, the closure moves upward, a bottom surface of the peripheral collar contacts the upper edge of the upward-angled ledge, the peripheral collar prevents the upward-angled ledge and the staying ring from moving upward, an upper surface of the skirt moves the downward-angled shoulder upward, moving the breakaway band upward and tearing the plurality of frangible connectors apart so that the breakaway band breaks away from the staying ring and the staying ring remains positioned under the peripheral collar.

2. The assembly of claim 1 wherein the breakaway band further comprises a continuous shoulder.

3. The assembly of claim 1 wherein the breakaway band further comprises a plurality of downward-angled tabs having tips extending inward and downward.

4. The assembly of claim 1 wherein the staying ring further comprises a continuous upward-angled ledge.

5. The assembly of claim 1 wherein the staying ring further comprises a plurality of upward-angled tabs.

6. The assembly of claim 1 wherein the upward-angled ledge forms an angle between 1-90 degrees.

7. The assembly of claim 1, wherein the staying ring has the thickness defined along a first transverse line of 0.010-0.100 inches.

8. The assembly of claim 7, wherein the staying ring has the thickness defined along a first transverse line of 0.030-0.080 inches.

9. The assembly of claim 7, wherein the staying ring has the thickness defined along a second transverse line of 0.010-0.10 inches.

10. The assembly of claim 1, wherein the plurality of frangible connectors extends laterally from an exterior face of the staying ring to an interior periphery of the breakaway band.

11. The assembly of claim 1, wherein the breakaway band and the staying ring have a circular shape.

12. The assembly of claim 1, wherein the assembly further comprises a snap-on closure.

13. The assembly of claim 12, wherein the assembly comprises at least one material selected from the group consisting of polypropylene, polyethylene, and polyolefin.

14. The assembly of claim 12, wherein the closure comprises at least one material from the group consisting of polycarbonate, acrylonitrile butadiene styrene, nylon, butadiene, proprionate, and acrylic polymers.

15. The assembly of claim 12, wherein the assembly comprises a different material than the closure.

* * * * *